US012390032B1

(12) United States Patent
Leach

(10) Patent No.: US 12,390,032 B1
(45) Date of Patent: Aug. 19, 2025

(54) BODY PILLOW WITH BOOSTER PILLOWS

(71) Applicant: Jamie S. Leach, Ada, OK (US)

(72) Inventor: Jamie S. Leach, Ada, OK (US)

( * ) Notice: Subject to any disclaimer, the term of this patent is extended or adjusted under 35 U.S.C. 154(b) by 687 days.

(21) Appl. No.: 16/891,360

(22) Filed: Jun. 3, 2020

(51) Int. Cl.
*A47G 9/10* (2006.01)

(52) U.S. Cl.
CPC ..... *A47G 9/1045* (2013.01); *A47G 9/1072* (2013.01)

(58) Field of Classification Search
CPC ..... A47G 9/1045; A47G 9/1054; A47G 9/1072; A47G 9/1063; A47G 9/109
See application file for complete search history.

(56) References Cited

U.S. PATENT DOCUMENTS

| | | | |
|---|---|---|---|
| 4,834,459 | A | 5/1989 | Leach |
| 4,861,109 | A | 8/1989 | Leach |
| D309,018 | S | 7/1990 | Leach |
| 5,103,514 | A | 4/1992 | Leach |
| 5,325,818 | A | 7/1994 | Leach |
| 6,343,727 | B1 | 2/2002 | Leach |
| 6,427,251 | B1 | 8/2002 | Leach |
| 6,499,164 | B1 | 12/2002 | Leach |
| 6,553,590 | B1 | 4/2003 | Leach |
| 6,601,252 | B1 | 8/2003 | Leach |
| 6,751,817 | B1 | 6/2004 | Leach |
| 6,760,934 | B1 | 7/2004 | Leach |
| 7,010,821 | B1 | 3/2006 | Leach |
| 7,114,206 | B2 | 10/2006 | Leach |
| 7,353,552 | B2 | 4/2008 | Leach |
| 7,500,278 | B2 | 3/2009 | Leach |
| 7,513,001 | B1 | 4/2009 | Leach |
| 7,562,406 | B1 | 7/2009 | Leach |
| 7,676,871 | B1 | 3/2010 | Leach |
| 7,708,342 | B2 | 5/2010 | Leach |
| 7,793,371 | B1 | 9/2010 | Leach |
| 7,878,587 | B1 | 2/2011 | Leach |
| 7,926,135 | B1 | 4/2011 | Leach |
| 8,136,186 | B1 | 3/2012 | Leach |
| 8,146,760 | B1 | 4/2012 | Leach |
| 8,419,128 | B1 | 4/2013 | Leach |
| 8,448,275 | B1 | 5/2013 | Leach |
| 8,468,627 | B2 | 6/2013 | Leach |
| 8,479,334 | B1 | 7/2013 | Leach |

(Continued)

OTHER PUBLICATIONS

The Leachco Two-by-You product shown in the packaging material attached as Exhibit 1 was in public use and/or on sale at least since about Oct. 12, 2005.

(Continued)

*Primary Examiner* — George Sun
(74) *Attorney, Agent, or Firm* — Mary M. Lee

(57) ABSTRACT

A body pillow with at least one auxiliary pillow. The body pillow may have two elongate leg sections joined by a center section, forming a generally U-shaped configuration. The body pillow may include one or more "booster" or auxiliary pillows. A first auxiliary pillow may be attached to one leg and a second auxiliary pillow may be attached to the other leg. Ideally, each of the auxiliary pillows is attached by means of a flexible, elastic connecting section. This allows each of the auxiliary pillows to be placed in multiple positions to provide additional support for different parts of the body. Ideally, the pillow comprises multiple pillow bodies received inside a removable cover.

30 Claims, 10 Drawing Sheets

(56) References Cited

U.S. PATENT DOCUMENTS

| | | | | |
|---|---|---|---|---|
| 8,555,429 | B2 | 10/2013 | Leach | |
| 8,661,587 | B1 | 3/2014 | Leach | |
| 8,661,588 | B1 | 3/2014 | Leach | |
| 8,671,480 | B1 | 3/2014 | Leach | |
| 8,914,927 | B1 | 12/2014 | Leach | |
| 9,003,565 | B1 | 4/2015 | Leach | |
| 9,021,635 | B1 * | 5/2015 | Leach | A47C 20/021 5/632 |
| 9,032,572 | B1 | 5/2015 | Leach | |
| 9,101,169 | B1 | 8/2015 | Leach | |
| 9,113,718 | B1 | 8/2015 | Leach | |
| 9,307,842 | B2 * | 4/2016 | Gibbons | A47C 20/021 |
| 9,635,956 | B1 | 5/2017 | Leach | |
| 9,693,638 | B1 | 7/2017 | Leach | |
| 10,729,257 | B1 | 8/2020 | Leach | |
| 10,736,444 | B1 | 8/2020 | Leach | |
| 10,806,278 | B1 | 10/2020 | Leach | |
| 11,039,399 | B2 | 6/2021 | Leach | |
| 2005/0278864 | A1 * | 12/2005 | Leach | A47C 20/023 5/732 |
| 2007/0022526 | A1 | 2/2007 | Leach | |
| 2007/0028384 | A1 | 2/2007 | Leach | |
| 2007/0046084 | A1 | 3/2007 | Leach | |
| 2007/0067914 | A1 * | 3/2007 | Littlehorn | A47C 16/02 5/636 |
| 2007/0151031 | A1 | 7/2007 | Leach | |
| 2007/0277321 | A1 | 12/2007 | Leach | |
| 2010/0175192 | A1 * | 7/2010 | Aiken | A47C 20/025 5/632 |
| 2012/0174320 | A1 * | 7/2012 | White Thomas | A47C 20/027 5/632 |
| 2014/0215719 | A1 * | 8/2014 | Gibbons | A47C 20/021 5/632 |
| 2015/0040320 | A1 * | 2/2015 | Gibbons | A47C 20/021 5/632 |
| 2015/0366361 | A1 * | 12/2015 | Lee | A47G 9/10 5/632 |
| 2016/0037946 | A1 * | 2/2016 | Melcher | A47C 20/023 |
| 2016/0106238 | A1 * | 4/2016 | Vargas | A47C 20/027 5/636 |
| 2017/0112302 | A1 * | 4/2017 | Taurins | A47G 9/1054 |
| 2019/0069686 | A1 * | 3/2019 | Miller | A47G 9/1036 |
| 2019/0231091 | A1 * | 8/2019 | Ross | A47C 20/025 |

OTHER PUBLICATIONS

The Leachco Lil' Snoogle product, which is shown and described in the webpage attached as Exhibit 2, was in public use and/or on sale at least as early as about Dec. 1999.

The Leachco All Nighter product, which is shown and described in the webpage attached as Exhibit 3, was in public use and/or on sale at least as early as about May 2002.

The Leachco Prop Ease product, which is shown and described in the packaging material attached as Exhibit 4, was in public use and/or on sale at least as early as about 2005.

The Leachco Snoogle product, which is shown and described in the webpage attached as Exhibit 5, was in public use and/or on sale at least as early as about May 1999.

The Leachco Mini Snoogle product, which is shown and described in the webpage attached as Exhibit 6, was in public use and/or on sale at least as early as about Dec. 1999.

The Leachco Snoogle Loop product, which is shown and described in the webpage attached as Exhibit 7, was in public use and/or on sale at least as early as about Dec. 1999.

The Leachco Snoozoo product, which is shown and described in the webpage attached as Exhibit 8, was in public use and/or on sale at least as early as about May 2005.

The Leachco Snoogle Half-Time product, which is shown and described in the webpage attached as Exhibit 9, was in public use and/or on sale at least as early as about Jul. 2005.

The Leachco Back 'N Belly product, which is shown and described in the webpage attached as Exhibit 10, was in public use and/or on sale at least as early as about Jun. 2003.

The Leachco Grow to Sleep pillow. which is shown and described in the webpage attached as Exhibit 11, was in public use and/or on sale at least as early as about Aug. 8, 2005.

The Leachco Preggle product, which is shown and described in the webpage attached as Exhibit 12, was in public use and/or on sale at least as early as about Dec. 2006.

The Leachco Boomerest pillow, which is shown and described in the webpage attached as Exhibit 13, was in public use and/or on sale at least as early as about May 23, 2005.

The Leachco Nogster pillow, which is shown and described in the webpage attached as Exhibit 14, was in public use and/or on sale at least as early as about Jul. 17, 2006.

The Leachco Back 'N Belly Bunchie pillow, which is shown and described in the webpage attached as Exhibit 15, was in public use and/or on sale at least as early as about Jun. 3, 2017.

* cited by examiner

BODY PILLOW WITH BOOSTER PILLOWS

FIELD OF THE INVENTION

The present invention relates generally to pillows and, more particularly but without limitation, to body pillows.

DETAILED DESCRIPTION OF AN EMBODIMENT OF THE INVENTION

Body pillows enjoy increasing popularity among consumers. While one major use is to provide back and abdominal support for expectant mothers, many others use body pillows for supporting the body while sleeping or reclining. The present invention provides a body pillow with one or more smaller auxiliary or "booster" pillows.

Figure 1:
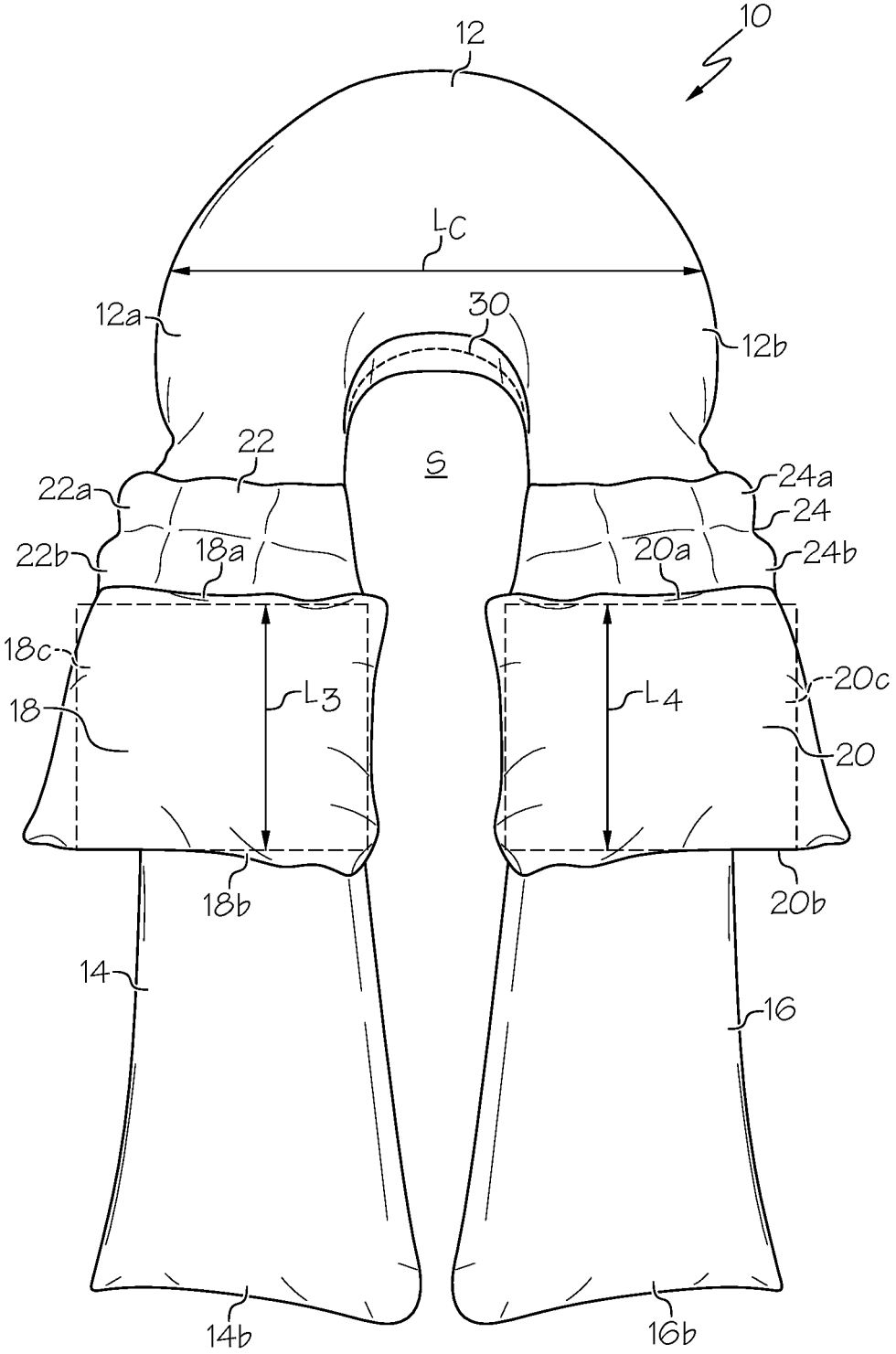
FIG. 1 is a plan view of a body pillow made in accordance with an embodiment of the present invention. The body pillow comprises two auxiliary or "mini" pillows; the two pillow bodies are shown in broken lines.
Figure 2:
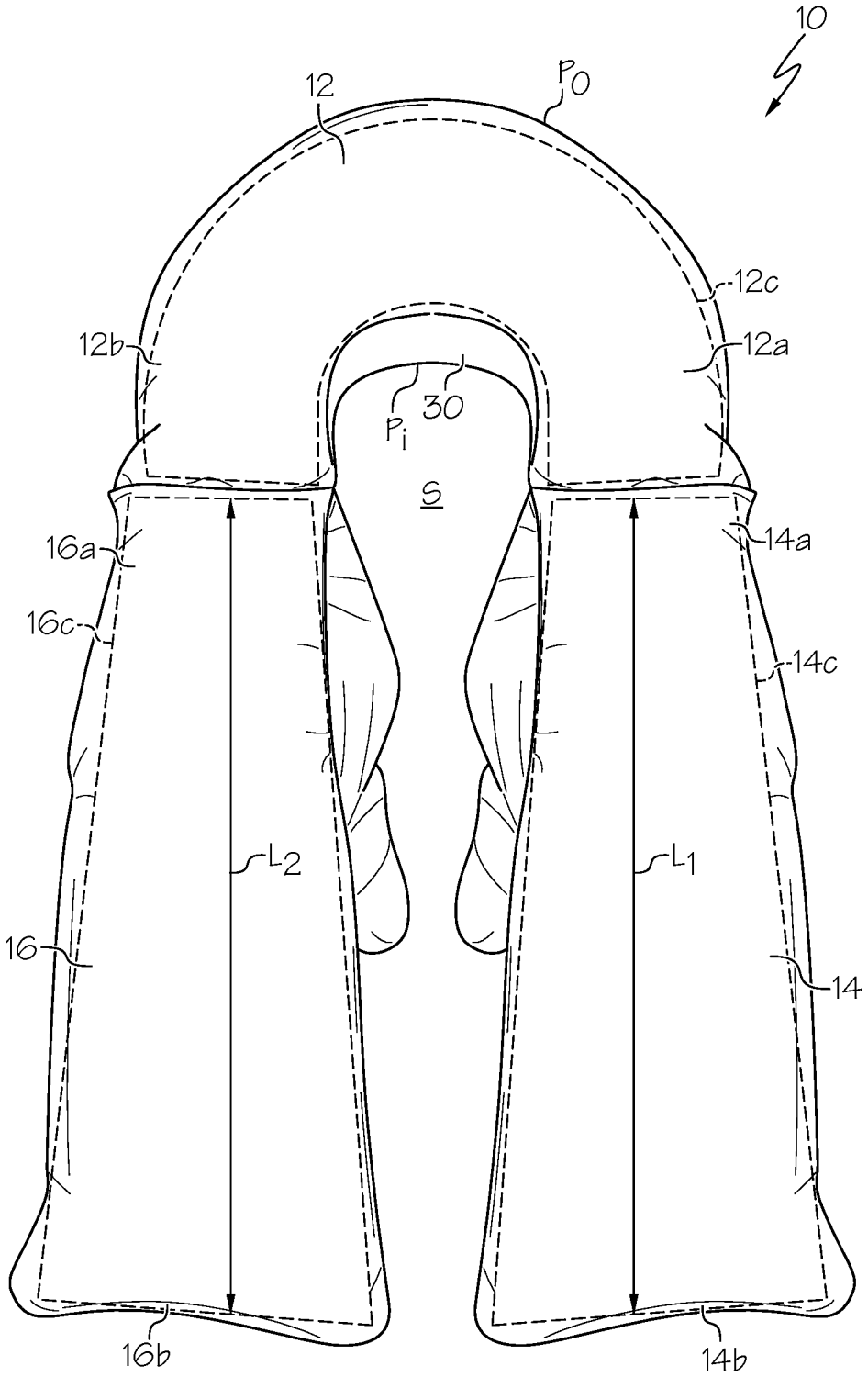
FIG. 2 is a bottom plan view of the body pillow in FIG. 1 illustrating in broken lines the pillow bodies of the two legs and the center section.
Figure 3:
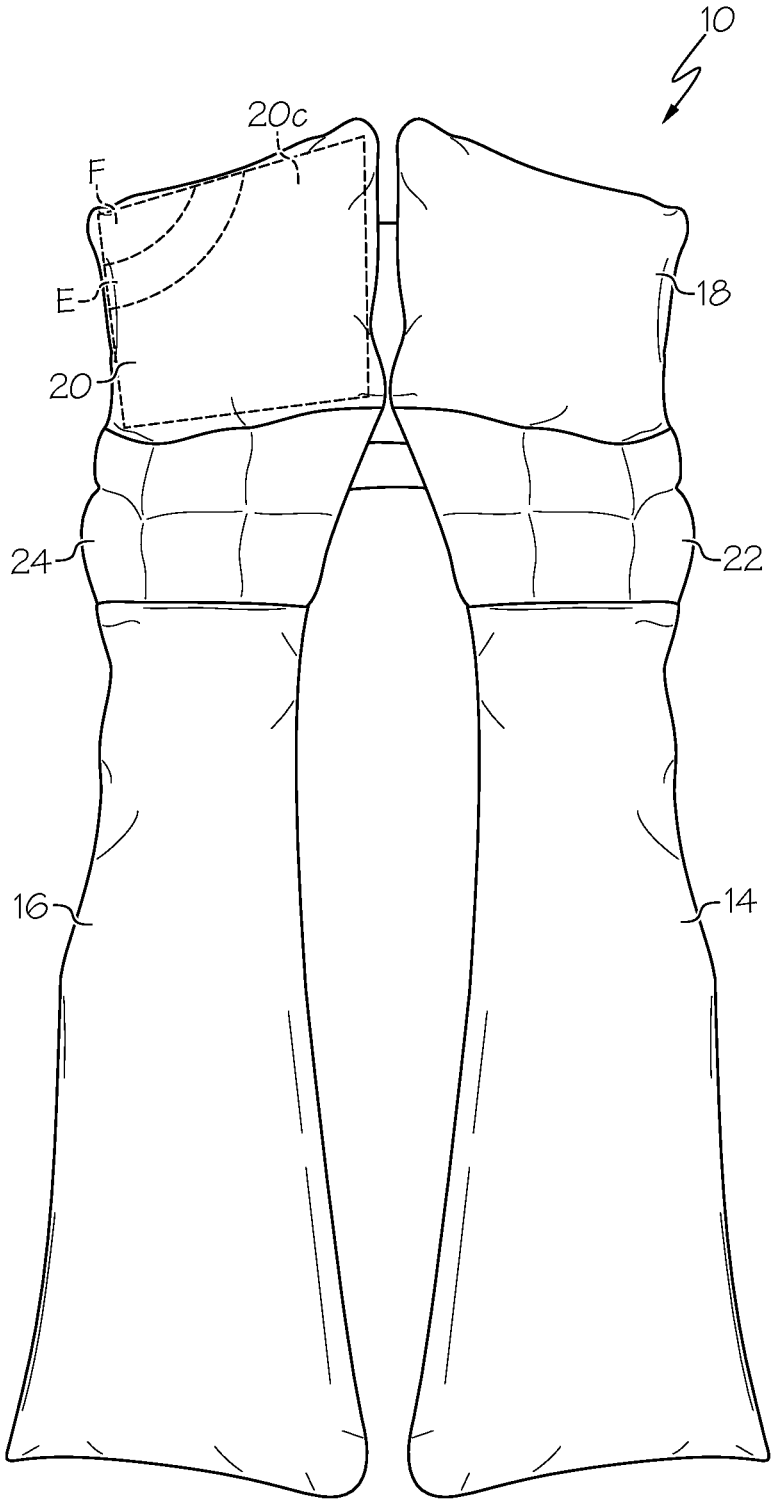
FIG. 3 is a plan view of the body pillow in FIG. 1 with the auxiliary pillows folded up towards the top of the pillow.

Turning now to the drawings in general and to FIGS. 1-3 in particular, there is shown therein a body pillow made in accordance with a first embodiment of the present invention and designated generally by the reference number 10. The pillow 10 may comprise a center section 12 and first and second legs 14 and 16.

The center section 12 has length "$L_C$" (FIG. 1) and a first end 12*a* and a second end 12*b*. Although the $L_C$ may vary, when sized for an average sized adult female, a suitable length is about twenty-five (25) inches to about thirty (30) inches, and may be about twenty-seven (27) inches. In the embodiment shown, the center section 12 is curved and, more specifically, the center section takes the form of a semi-circle. However, this shape may vary. By way of example, the center section could be rectangular or could form a square "U" shape.

The first leg 14 has length "$L_1$" (FIG. 2) and a first end 14*a* and a second end 14*b*. The first end 14*a* of the first leg 14 is attached to the first end 12*a* of the center section 12. The second leg 16 has a length "$L_2$" (FIG. 2), a first end 16*a*, and a second end 16*b*. The first end 16*a* of the first leg 16 is attached to the second end 12*b* of the center section 12. Now it will be seen that, in this embodiment, the center section 12, the first leg 14, and the second leg 16 define a body receiving space "S" between the first and second legs. In the exemplary embodiment, the legs 14 and 16 are similarly sized and shaped and comprise an elongate, straight section terminating in flat, slightly widened ends 14*b* and 16*b*. However, the configuration of the legs may vary. Although the lengths $L_1$ and $L_2$ may vary, when sized for an average sized adult female, a suitable length is about thirty (30) to about thirty-five (35) inches and may be about thirty-two (32) inches.

As shown best in FIGS. 1 and 3, the inventive body pillow may comprise at least one auxiliary pillow. In the embodiment illustrated herein the body pillow 10 comprises a plurality of auxiliary pillows, namely, a first auxiliary pillow 18 and a second auxiliary pillow 20. The first auxiliary pillow 18 has a length "$L_3$" (FIG. 1) and first and second ends 18*a* and 18*b*. The pillow 18 may be flexibly attached to one of the legs, such as the first leg 14. Further, the pillow 18 may be elastically attached to the first leg 14. To that end, the body pillow 10 may include a first elastic connecting section 22 having a first end 22*a* and a second end 22*b*. The first end 22*a* may be attached to the body pillow 10 and the second end 22*b* of the connecting section 22 may be attached to the first end 18*a* of the auxiliary pillow 18.

In the illustrated embodiment, the first end 22*a* of the connecting section 22 is attached to the body pillow 10 at the junction between the first end 12*a* of the center section 12 and the first end 14*a* of the first leg, though this position may vary. Further, in the embodiment shown, the length $L_3$ of the first auxiliary pillow 18 is less than one-half the length of the first leg 14, and may be less than one-third the length of the first leg 14, but the relative lengths of the various pillow sections may vary.

The second auxiliary pillow 20 has a length "$L_4$" (FIG. 1) and first and second ends 20*a* and 20*b*. The pillow 20 may be flexibly attached to one of the legs, such as the second leg 16. Further, the pillow 20 may be elastically attached to the second leg 16. To that end, the body pillow 10 may include a second elastic connecting section 24 having a first end 24*a* and a second end 24*b*. The first end 24*a* may be attached to the body pillow 10 and the second end 24*b* of the connecting section 24 may be attached to the first end 18*a* of the auxiliary pillow 18.

In the illustrated embodiment, the first end 24*a* of the second connecting section 24 is attached to the body pillow 10 at the junction between the second end 12*b* of the center section 12 and the first end 16*a* of the second leg, though this position may vary. Further, in the embodiment shown, the length $L_4$ of the second auxiliary pillow 20 is less than one-half the length of the second leg 16, and may be less than one-third the length of the second leg 16, but the relative lengths of the various pillow sections may vary.

Additionally, although in the exemplary embodiment shown herein, the auxiliary pillows 18 and 20 are attached at the same locations on the two legs of the body pillow 10, alternately they may be attached at different locations. The auxiliary pillows 18 and 20 may be square "knife-edge" pillows, as shown. However, the sizes and shapes of the auxiliary pillows 18 and 20 as well as the connecting sections 22 and 24 may vary.

The construction of the body pillow 10 can be done according to well-known techniques. In the illustrative embodiment, the body pillow 10 is constructed using a plurality of pillow bodies comprising resilient, compressible material, each pillow body being contained in a fabric enclosure, such as the filler "F" contained in the enclosure "E" forming the pillow body 20*c* of the second auxiliary pillow 20, as shown in FIG. 3. The fabric enclosure E may be any suitable fabric, including but not limited to a polyester/cotton blend, waterproof nylon, cotton, flannel, or elastic fabrics, such as spandex or cotton-spandex blends. One suitable filler material F is polyester fiberfill. Other suitable fillers include down feathers, memory foam, and polystyrene pellets. Still further, the compressible material could be an inflatable insert.

As indicated and as best seen in FIG. 2, the inner perimeter $P_i$ (FIG. 2) of the center section 12 may define a semi-circle, as shown. The outer perimeter $P_o$(FIG. 2) of the center section 12 may also form a semi-circle. In one embodiment, as shown, the semi-circle formed by the inner perimeter $P_i$ of the center section 12 and the semi-circle formed by the outer perimeter $P_o$ of the center section are concentric. As used herein, "semi-circle" denotes a generally curved shape and does not require a precise radius of curvature or an arc of precisely 180 degrees. Alternately, the outer perimeter may be angular (polygonal), or may form square corners. Still further, the center section may be square or rectangular so that the inner and outer perimeters are straight.

Referring still to FIGS. 1 and 2, the inner perimeter $P_i$ of the center section 12 may be provided with a tension relief gusset 30. The shape and dimensions of the gusset may vary. In the embodiment shown, the gusset extends the length the inner perimeter. The gusset may be one to several inches wide at its center and taper to a point at each end. The gusset makes it easier to manipulate the legs as there is no center seam offering resistance.

The elastic sections 22 and 24 may be made elastic by forming gathers in a known manner. Alternately, the elastic sections 22 and 24 may be made of stretchable fabric. The elastic sections 22 and 24 may also be twistable. The connecting sections 22 and 24 may be permanently attached, as by stitching, to the body pillow 10. Alternately, the elastic connecting sections 22 and 24 may be removably attachable to the body pillow 10 by fasteners, such as hook-and-loop fasteners, zippers, buttons, ties, snaps, and the like.

The manner of constructing the elasticized sections 22 and 24 may vary. The elasticized sections 22 and 24 may be formed by stitching or otherwise affixing one or more strips of elastic along the length of the fabric sections forming the elasticized sections. The elastic is stitched with the fabric and the elastic strip in the fully expanded length so that, when released, the sections 22 and 24 become gathered along the lines where the elastic bands are stitched.

The length of the unstretched elasticized sections may vary, although an ideal length is between about eight (8) and about sixteen (16) inches. More preferably, the length may be between about ten (10) and fourteen (14) inches, and most preferably is between about eleven (11) and twelve (12) inches in length. The extended length of the elasticized sections 22 and 24 may be between about fourteen (14) and about twenty-two (22) inches and preferably is about eighteen (18) inches.

Attachment tabs or connectors (not shown) may be included on the auxiliary pillows. By way of example, attachment tabs could be provided on the edge of the pillow opposite the end that attaches to the elastic section. Mating tabs could be provided in various locations on the body pillow. In this way, once the auxiliary pillow has been repositioned, it can be secured in that position with the attachment tab or connector. These connectors may be any type of fastener, such as hook-and-loop fasteners, zippers, buttons, ties, snaps, and the like.

The body pillow may have only one leg and one auxiliary pillow. The two-legged U-shaped pillow 10 shown may have only one auxiliary pillow. The positions at which the one or more auxiliary pillows are attached may vary, the positions depicted being exemplary only. The contours and dimensions of the legs may vary. Moreover, the contour and dimensions of the first leg may be the same or may be different from the contour and dimensions of the second leg. In the embodiment shown in FIG. 1, the first and second legs 14 and 16 are similarly formed having the same overall length, and the contours of the inner perimeters are mirror images of each other.

Attachment tabs or connectors (not shown) may be included on the body pillow 10 in various locations, such as the ends of the legs. In this way, the ends of the legs 14 and 16 may be attached to each other or secured in a selected position. Additionally, as explained above, the attachment tabs on the body pillow 10 can be used to secure the auxiliary pillows 18 and 20 in a selected position or arrangement. These connectors may be any type of fastener, such as hook-and-loop fasteners, zippers, buttons, ties, snaps, and the like.

Figure 4:
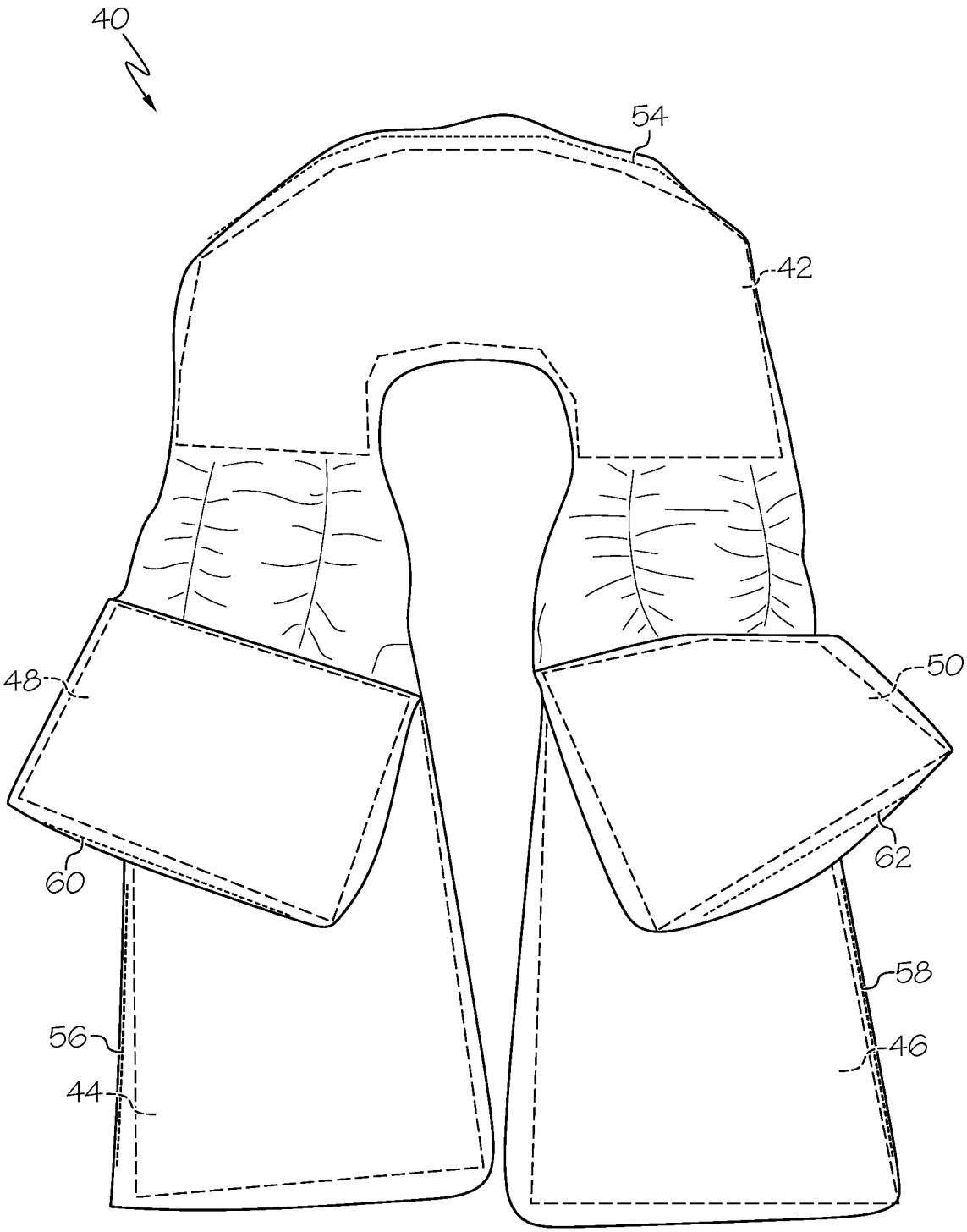
FIG. 4 is a plan view of an empty removable cover of the body pillow of FIG. 1 and indicating with dashed lines the position of zippered openings for inserting the pillow bodies.

In one preferred manner of construction, the plurality of pillow bodies comprises a center section 12*c*, first and second legs 14*c* and 16*c*, and first and second auxiliary pillows 18*c* and 20*c*. These pillow bodies may be contained inside a removable cover 40, shown in FIG. 4 without the pillow bodies inside. In this way, the cover may be removed for laundering or replaced with a different color or fabric design.

The cover 40 includes a center compartment 42 for the center section pillow body 12*c*, first and second leg compartments 44 and 46 for the first and second leg pillow bodies 14*c* and 16*c*, respectively, and first and second auxiliary compartments 48 and 50 for the first and second auxiliary pillow bodies 18 and 20, respectively. Each of these compartments may be configured to conform closely to the shape of the pillow body.

An opening is provided in each compartment through which the pillow body may be inserted and withdrawn. The size and location of the openings may vary. The openings may be a zipper, such as the zippers 54, 56, 58, 60, and 62. The size of the openings should allow ample room to manipulate the pillow body into and out of the cover as needed. While zippers are shown as one exemplary closure device, the closure device may vary, and may be snaps, hooks, ties, buttons, hook-and-loop fasteners, a simple overlapping sham-style closure, or a combination of these.

Figure 15:
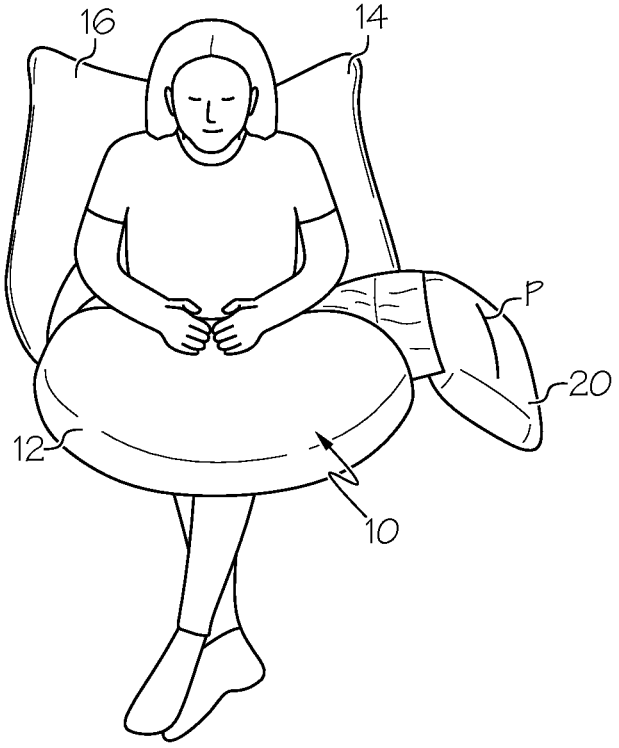
FIG. 15 is a perspective view of a user using the body pillow of FIG. 1. The user is in a seated position with her back supported by the upwardly extending legs of the body pillow. The center section of the body pillow is positioned over her legs to serve as a lap pillow. One of the auxiliary pillows is folded behind her back for additional support, and the other is laid out to side making the built-in pocket accessible.

As shown in FIG. 15, a pocket "P" is provided on one side of the second auxiliary pillow 20. Although not illustrated here, any or all of the other pillows may be provided with a pocket.

The body pillow 10 may be sized so that its overall length (from the top of the center section to the ends of the legs, as seen in FIGS. 1-3) generally is about equal to the height of the intended user. In one embodiment, the length of the pillow is such that when a user is lying in the body receiving space S (FIGS. 1&2) with her head resting on the center section 12, the second ends 14*b* and 16*b* of the legs 14 and 16 will be long enough to support the user's lower legs and feet. Although the overall length of the body pillow 10 may vary, when sized for an average sized adult female, a suitable length is about fifty (50) to about sixty (60) inches, and may be about fifty-five (55) inches. Now it will be apparent that the body pillow 10 may be provided in different sizes for children, men, and women.

In accordance with the method of the present invention, the body pillow 10 may be configured by repositioning the one or more auxiliary pillows, as depicted in FIGS. 5-16, to which attention now is directed.

Figure 5:
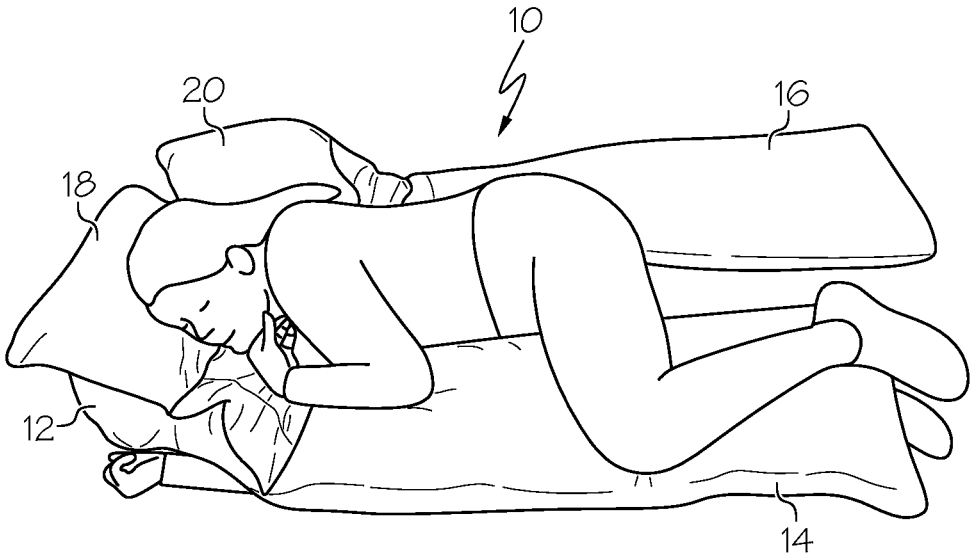
FIG. 5 is a perspective view of a user using the body pillow of FIG. 1 in a side-lying position. One of the auxiliary pillows is providing extra head support.
Figure 6:
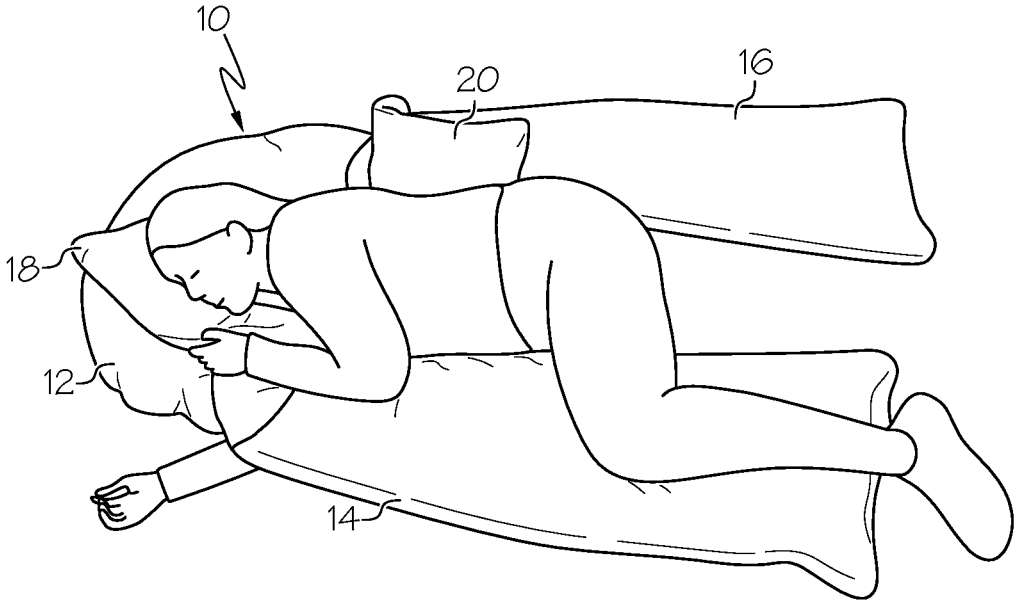
FIG. 6 is a perspective view of a user using the body pillow of FIG. 1 in a side-lying position. One of the auxiliary pillows is providing extra head support and the other is providing back support.
Figure 7:
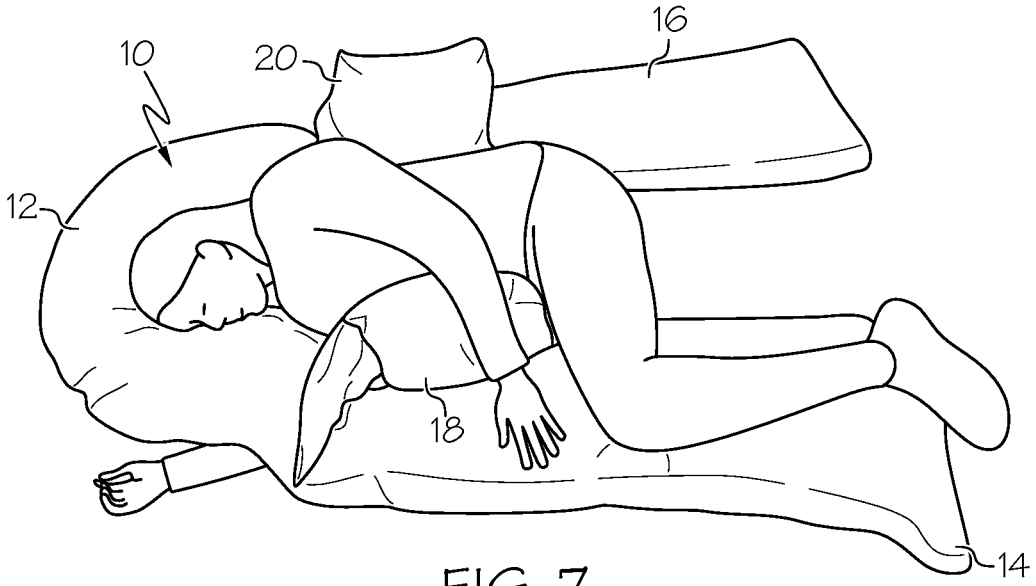
FIG. 7 is a perspective view of a user using the body pillow of FIG. 1 in a side-lying position. One of the auxiliary pillows is providing extra belly support and the other is providing back support.
Figure 8:
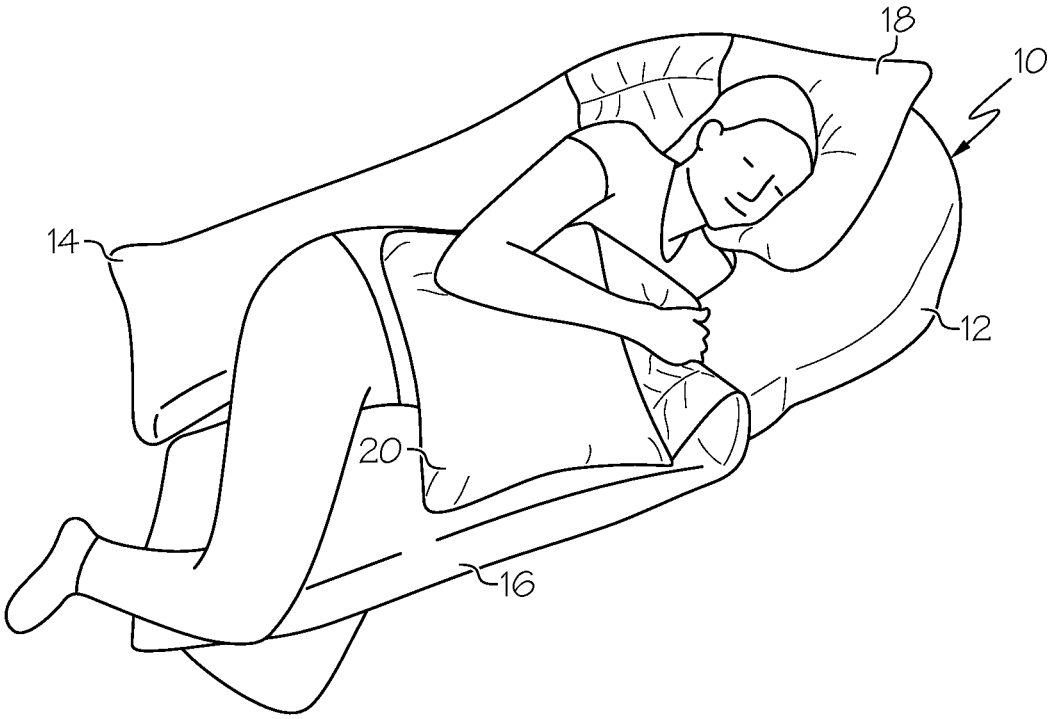
FIG. 8 is a perspective view of a user using the body pillow of FIG. 1 in a side-lying position. One of the auxiliary pillows is providing extra head support and the other is supporting the user's arm.

FIG. 5 is a perspective view of a user using the body pillow 10 of FIG. 1 in a side-lying position. In this position, one of the auxiliary pillows 18 is providing extra head support. FIG. 6 is a perspective view of a user using the body pillow 10 of FIG. 1 in another side-lying position in which one of the auxiliary pillows 18 is providing extra head support and the other auxiliary pillow 20 is providing back support. FIG. 7 is a perspective view of another side-lying position, in which one auxiliary pillow 18 is providing extra belly support and the other 20 is providing back support. FIG. 8 is a perspective view of a user using the body pillow 10 of FIG. 1 in yet another side-lying position, in which one of the auxiliary pillows 18 is providing extra head support and the other 20 is supporting the user's arm.

Figure 9:
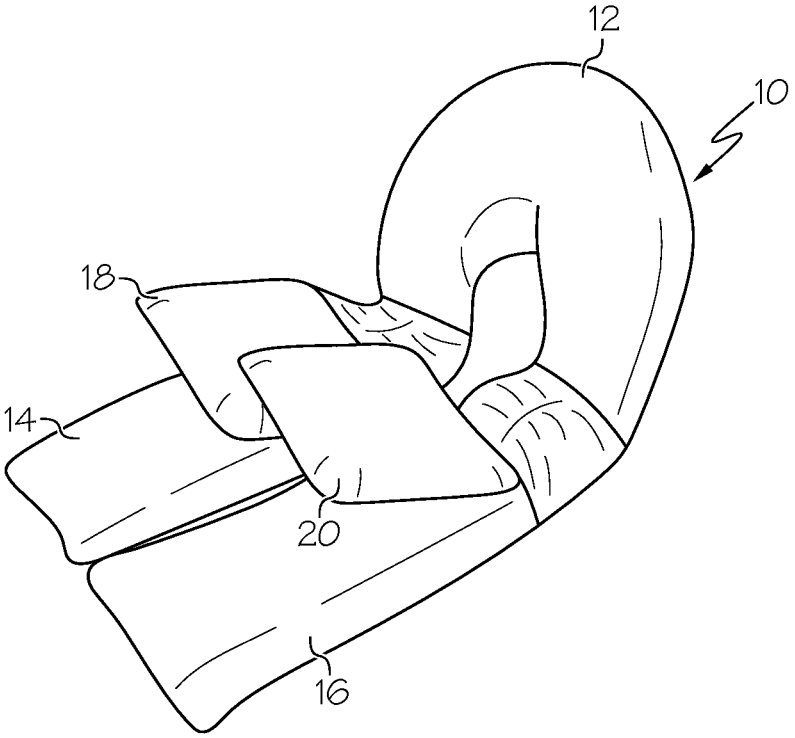
FIG. 9 is a perspective view of the body pillow of FIG. 1 configured for use in a seated position.
Figure 10:
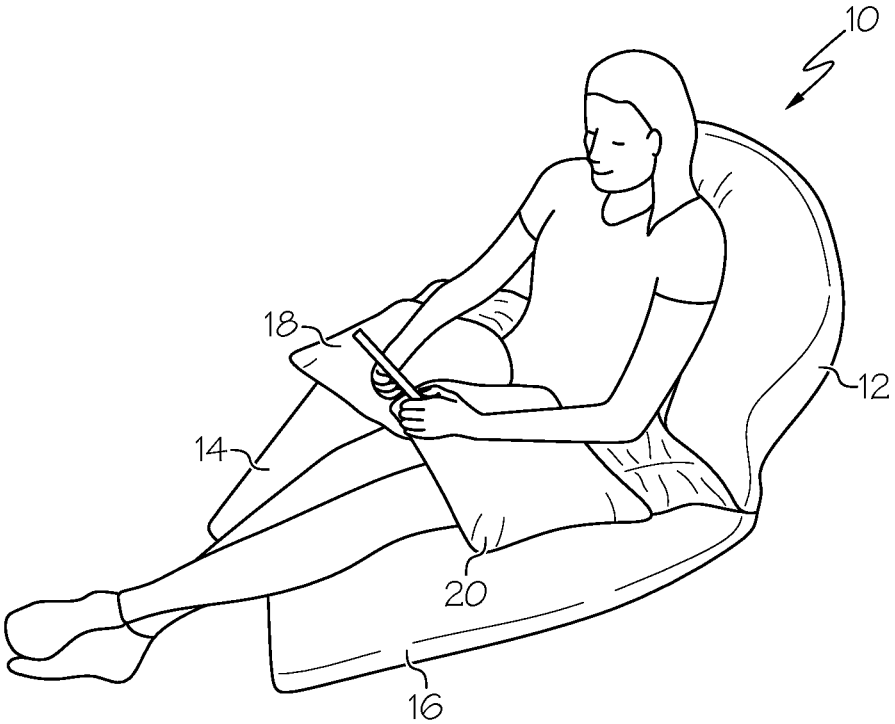
FIG. 10 is a perspective view of a user using the body pillow of FIG. 1 positioned as shown in FIG. 9. The user is in a seated position with her back supported by the center section of the body pillow and the auxiliary pillows serving as arm rests.

FIG. 9 is a perspective view of the body pillow 10 of FIG. 1 configured for use in a seated position. FIG. 10 illustrates a user siting in the body pillow 10 configured as in FIG. 9. The user's back supported by the center section 12 of the body pillow 10 and the auxiliary pillows 18 and 20 are serving as bilateral arm rests.

Figure 11:
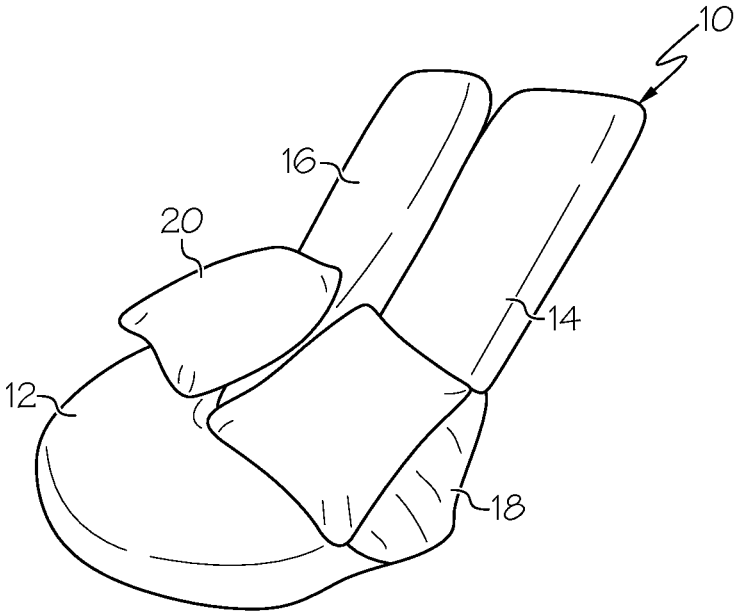
FIG. 11 is a perspective view of the body pillow of FIG. 1 configured for use in a second seated position.
Figure 12:
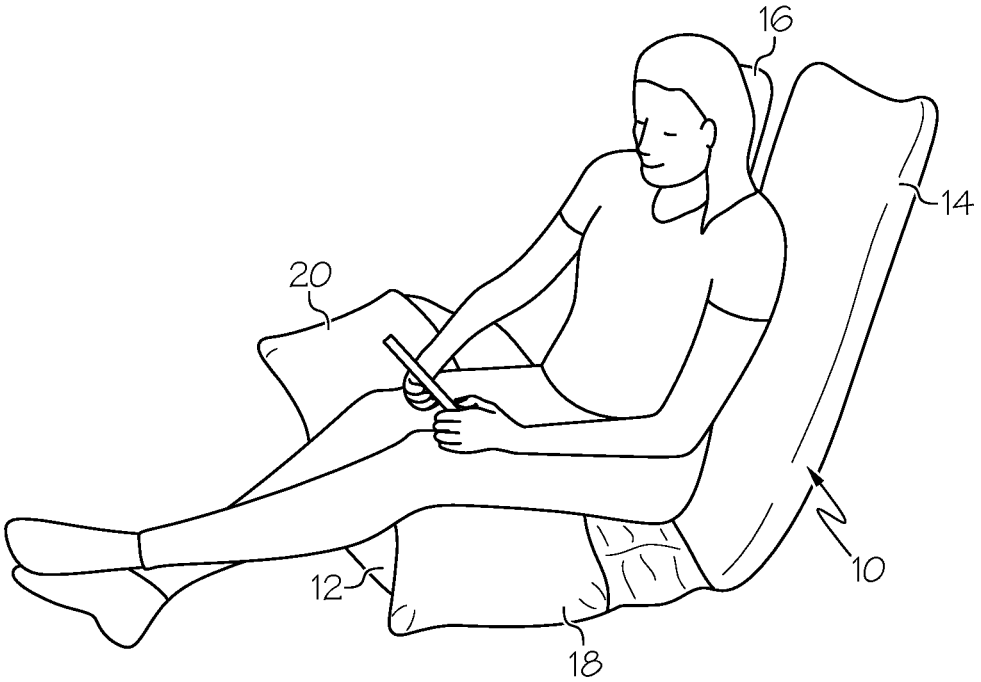
FIG. 12 is a perspective view of a user using the body pillow of FIG. 1 positioned as shown in FIG. 11. The user is in a seated position with her back supported by the upwardly extending legs of the body pillow. The center section of the body pillow is positioned under her legs, and the auxiliary pillows are positioned under her knees for additional support.

FIG. 11 is a perspective view of the body pillow 10 of FIG. 1 configured for use in a second seated position. FIG. 12 is a perspective view of a user using the body pillow 10 of FIG. 1 positioned as shown in FIG. 11. The user is in a seated position with her back supported by the upwardly extending legs 14 and 16 of the body pillow 10. The center section 12 of the body pillow 10 is positioned under her legs, and the auxiliary pillows 18 and 20 are positioned under her knees for additional support.

Figure 13:
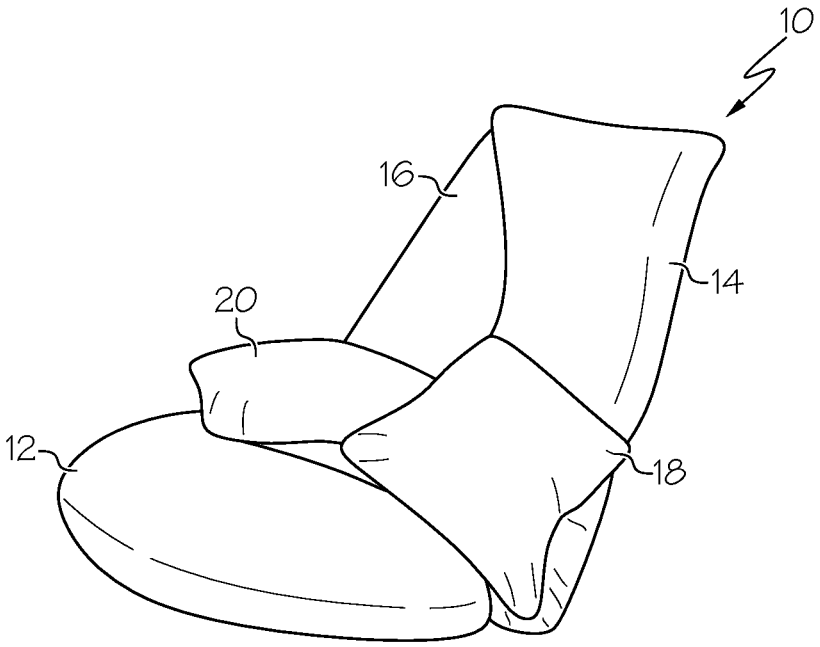
FIG. 13 is a perspective view of the body pillow of FIG. 1 configured for use in a third seated position.
Figure 14:
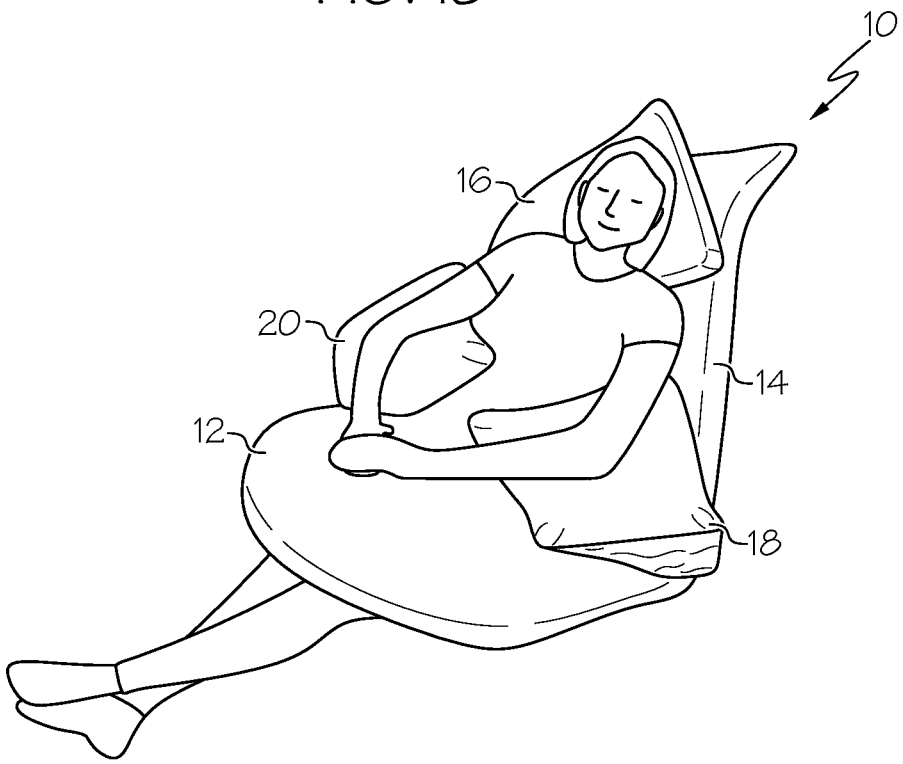
FIG. 14 is a perspective view of a user using the body pillow of FIG. 1 positioned as shown in FIG. 13. The user is in a seated position with her back supported by the upwardly extending legs of the body pillow. The center section of the body pillow is positioned over her legs to serve as a lap pillow. The auxiliary pillows are supporting her arms.

FIG. 13 is a perspective view of the body pillow 10 of FIG. 1 configured for use in a third seated position. FIG. 14 is a perspective view of a user using the body pillow 10 of FIG. 1 positioned as shown in FIG. 13. The user is in a seated position with her back supported by the upwardly extending legs 14 and 16 of the body pillow 10. The center section 12 of the body pillow 10 is positioned over her legs to serve as a lap pillow. The auxiliary pillows 18 and 20 are supporting her arms.

FIG. 15 is a perspective view of a user using the body pillow 10 of FIG. 1. The user is in a seated position with her back supported by the upwardly extending legs 14 and 16 of the body pillow 10. The center section 12 of the body pillow 10 is positioned over her legs to serve as a lap pillow. One of the auxiliary pillows 18 (not seen in this view) is folded behind her back for additional support, and the other auxiliary pillow 20 is laid out to side making the built-in pocket P accessible.

Figure 16A:
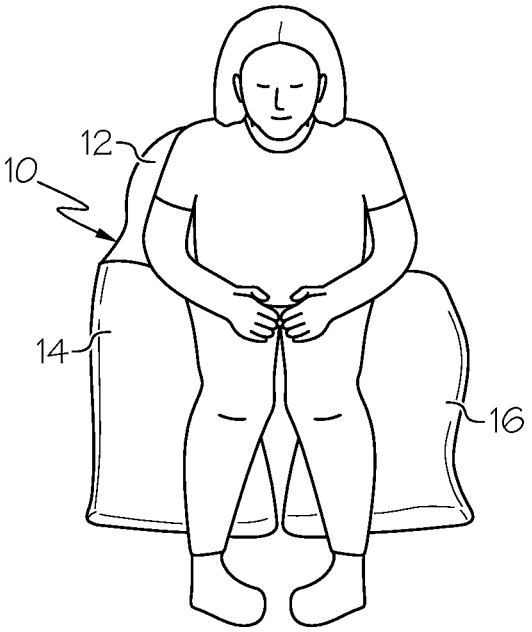
FIG. 16 is a perspective view of a user using the body pillow of FIG. 1 in a seated position with her upper back supported by the center section of the body pillow and her lower back supported by the inwardly folded auxiliary pillows.
Figure 16B:
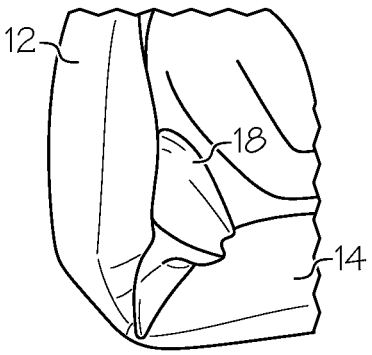

FIG. 16 is a perspective view of a user using the body pillow 10 of FIG. 1 in a seated position with her upper back supported by the center section 12 of the body pillow 10 and her lower back supported by the inwardly folded auxiliary pillows 18 and 20 (not shown in this view).

The following issued United States patents are incorporated herein by reference: (1) U.S. Pat. No. 7,793,371, entitled "Apparatus and Method for Question Mark-Shaped Body Pillow and Support System," issued Sep. 14, 2010; (2) U.S. Pat. No. 8,468,627, entitled "Elongated Angular Multiple Position Body Pillow," issued Jun. 25, 2013; (3) U.S. Pat. No. 7,010,821, entitled "Expandable Double Nursing Pillow," issued Mar. 14, 2006; (4) U.S. Pat. No. 7,353,552, entitled "Multiple Position Symmetrically Contoured Body Pillow," issued Apr. 8, 2008; (5) U.S. Pat. No. 6,499,164, entitled "Body Pillow With Horseshoe-Shaped Top and J-Shaped Bottom," issued Dec. 31, 2002; (6) U.S. Pat. No. 6,751,817, entitled "Contoured Body Pillow," issued Jun. 22, 2004; (7) U.S. Pat. No. 6,760,934, entitled "Symmetrically Contoured Support Pillow," issued Jul. 13, 2004; (8) U.S. Pat. No. 9,021,635, entitled "Body Pillow with Multiple Configurations," issued May 5, 2015. These patents describe the various techniques and materials related to the making of body pillows.

The embodiments shown and described above are exemplary. Many details are often found in the art and, therefore, many such details are neither shown nor described herein. It is not claimed that all of the details, parts, elements, or steps described and shown herein are newly invented. Changes may be made in the details, especially in matters of shape, size, and arrangement of the parts, within the principles of the invention to the full extent indicated by the broad meaning of the terms in the attached claims. The description and drawings of the specific embodiments herein do not point out what an infringement of this patent would be, but rather provide non-limiting examples of how to use and make the invention. Likewise, the abstract is neither intended to define the invention, which is measured by the claims, nor is it intended to be limiting as to the scope of the invention in any way. The limits of the invention and the bounds of the patent protection are measured by and defined in the following claims.

What is claimed is:

1. A body pillow comprising:

a center section having a length and a first end and a second end;

a first leg having a length and a first end and a second end, the first end of the first leg attached to the first end of the center section;

a second leg having a length and having a first end and a second end, the first end of the second leg attached to the second end of the center section;

wherein the center section, the first leg, and the second leg define a body receiving space between the first and second legs; and a first auxiliary pillow having a first end and a second free end and a length, wherein the length of the first auxiliary pillow is less than half the length of the first leg wherein the first end of the first auxiliary pillow is elastically and pivotally attached to the body pillow at a location whereby the first auxiliary pillow is pivotable between a first position in which the first auxiliary pillow overlies at least a portion of the first leg and a second position in which the first auxiliary pillow overlies the first end of the center section;

a flexible, elastic connecting section having first and second ends, the first end of the connecting section attached to the body pillow and the second end of the connecting section is attached to the first end of the first auxiliary pillow; and wherein the center section, first and second legs, and first auxiliary pillow each comprises compressible, resilient material.

2. The body pillow of claim 1 further comprising a second auxiliary pillow comprising compressible, resilient material, having a length, and being elastically attached to the body pillow.

3. The body pillow of claim 2 wherein the length of the second auxiliary pillow is less than half the length of the second leg, wherein the body pillow further comprises a second flexible, elastic connecting section having first and second ends, the first end of the second connecting section attached to the body pillow and the second end of the second connecting section is attached to the first end of the second auxiliary pillow, wherein the first end of the second auxiliary pillow is elastically and pivotally attached to the body pillow at a location whereby the second auxiliary pillow is pivotable between a first position in which the second auxiliary pillow overlies at least a portion of the second leg and a second position in which the second auxiliary pillow overlies the second end of the center section.

4. The body pillow of claim 3 wherein the first and second legs are similarly sized and shaped.

5. The body pillow of claim 4 wherein the first and second auxiliary pillows are similarly sized and shaped.

6. The body pillow of claim 5 wherein the first auxiliary pillow is attached between the first end of the first leg and the first end of the center section and the second auxiliary pillow is attached between the first end of the second leg and the second end of the center section.

7. The body pillow of claim 1 wherein the center section is curved.

8. The body pillow of claim 7 wherein the center section is semi-circular.

9. The body pillow of claim 8 wherein each of the first and second legs comprises a straight elongate section.

10. The body pillow of claim 1 wherein each of the first and second legs comprises a straight elongate section.

11. The body pillow of claim 3 wherein each of the center section, the first and second legs, and the first and second auxiliary pillows comprises a pillow body, wherein the body pillow further comprises a removable cover configured with a plurality of compartments including one compartment configured to receive and conform to the shape of one of the center section, the first and second legs, and the first and second auxiliary pillows, wherein the first end of the first connecting section is attached to the removable cover between the first end of the center section and the first end of the first leg, wherein the first end of the second connecting section is attached to the removable cover between the second end of the center section and the first end of the second leg.

12. The body pillow of claim 11 wherein the first and second legs are similarly sized and shaped.

13. The body pillow of claim 12 wherein the first and second auxiliary pillows are similarly sized and shaped.

14. The body pillow of claim 13 wherein the center section is curved.

15. The body pillow of claim 14 wherein each of the first and second connecting sections is elastic.

16. A removable cover for a body pillow, wherein the body pillow comprises a plurality of pillow bodies including a center section having a length and first and second ends, a first leg having a length and first and second ends, a second leg having a length and first and second ends, at least one auxiliary pillow having a length and first and second ends, the at least one auxiliary pillow comprising a first auxiliary pillow, and wherein the pillow bodies of the center section, first and second legs, and first auxiliary pillow, comprise compressible, resilient material, the cover comprising:

a fabric enclosure configured to form a plurality of compartments including one compartment configured to receive and conform to the shape of a different one of the plurality of pillow bodies of the body pillow, wherein the fabric enclosure is configured so that the compartment for the at least one auxiliary pillow has a first end and a second end corresponding to the first and second ends of the at least one auxiliary pillow, and wherein the second end of the compartment for the at least one auxiliary pillow is unattached to the fabric enclosure to permit pivotal movement between a first position in which the first auxiliary pillow compartment overlies at least a portion of the first leg compartment and a second position in which the first auxiliary pillow compartment overlies the first end of the center section compartment;

an elastic connecting section for each of the at least one auxiliary pillows included in the plurality of pillow bodies of the body pillow, including a first elastic connecting section for the first auxiliary pillow, each such connection section having a first end and a second end, wherein the first end of the first elastic connecting section is attached to the removable cover between the first end of the center section compartment and the first end of the first leg compartment, and wherein the second end of the first elastic connecting section is attached to the compartment configured to receive the first auxiliary pillow; and wherein, when the pillow bodies of the body pillow are received in their respective compartments in the fabric enclosure, the center section and first and second legs define a body receiving space between the first and second legs.

17. The removable cover of claim 16 wherein the plurality of pillow bodies of the body pillow comprises a second auxiliary pillow, wherein the removable cover further comprises:

a second elastic connecting section having a first end and a second end, wherein the first end of the second elastic connecting section is attached to the removable cover between the second end of the center section compartment and the first end of the second leg compartment, and wherein the second end of the second elastic connecting section is attached to the compartment configured to receive the second auxiliary pillow.

18. The removable cover of claim 16 wherein the first and second legs of the body pillow are similarly sized and shaped.

19. The removable cover of claim 16 wherein the first and second auxiliary pillows of the body pillow are similarly sized and shaped.

20. The removable cover of claim 16 wherein the center section of the body pillow is curved.

21. A body pillow comprising:

the removable cover of claim 16; and a plurality of pillow bodies including a center section pillow body, a first leg pillow body, a second leg pillow body, and a first auxiliary pillow body.

22. A body pillow comprising:

the removable cover of claim 17; and a plurality of pillow bodies including a center section pillow body, a first leg pillow body, a second leg pillow body, a first auxiliary pillow body, and a second auxiliary pillow body.

23. A body pillow comprising:

a center section having a length and a first end and a second end;

a first leg having a length and a first end and a second end, the first end of the first leg attached to the first end of the center section;

a second leg having a length and having a first end and a second end, the first end of the second leg attached to the second end of the center section;

wherein the center section, the first leg, and the second leg define a body receiving space between the first and second legs; and a first auxiliary pillow having a first end and a second free end and a length, wherein the length of the first auxiliary pillow is less than half the length of the first leg, wherein the first end of the first auxiliary pillow is elastically and pivotally attached to the body pillow at a location whereby the first auxiliary pillow is pivotable between a first position in which the first auxiliary pillow overlies at least a portion of the first leg and a second position in which the first auxiliary pillow overlies the first end of the center section;

a first flexible, elastic connecting section having first and second ends, the first end of the first connecting section attached to the body pillow and the second end of the first connecting section is attached to the first end of the first auxiliary pillow; and a second auxiliary pillow having a first end and a second free end and a length, wherein the length of the second auxiliary pillow is less than half the length of the second leg, wherein the first end of the second auxiliary pillow is elastically and pivotally attached to the body pillow at a location whereby the second auxiliary pillow is pivotable between a first position in which the second auxiliary pillow overlies at least a portion of the second leg and a second position in which the second auxiliary pillow overlies the second end of the center section;

a second flexible, elastic connecting section having first and second ends, the first end of the second connecting section attached to the body pillow and the second end of the second connecting section is attached to the first end of the second auxiliary pillow; and wherein the center section, first and second legs, and first and second auxiliary pillows each comprises compressible, resilient material.

24. The body pillow of claim 23 wherein the first auxiliary pillow is attached between the first end of the first leg and the first end of the center section and the second auxiliary pillow is attached between the first end of the second leg and the second end of the center section.

25. The body pillow of claim 23 wherein each of the center section, the first and second legs, and the first and second auxiliary pillows comprises a pillow body, wherein the body pillow further comprises a removable cover configured with a plurality of compartments including one compartment configured to receive and conform to the shape of one of the center section, the first and second legs, and the first and second auxiliary pillows, wherein the first end of the first connecting section is attached to the removable cover between the first end of the center section and the first end of the first leg, wherein the first end of the second connecting section is attached to the removable cover between the second end of the center section and the first end of the second leg.

26. A body pillow comprising:

a center section having a length and a first end and a second end, wherein the center section is semi-circular;

a first leg having a length and a first end and a second end, the first end of the first leg attached to the first end of the center section;

a second leg having a length and having a first end and a second end, the first end of the second leg attached to the second end of the center section;

wherein the center section, the first leg, and the second leg define a body receiving space between the first and second legs; and a first auxiliary pillow having a first end and a second free end and a length, wherein the first end of the first auxiliary pillow is elastically and pivotally attached to the body pillow at a location whereby the first auxiliary pillow is pivotable between a first position in which the first auxiliary pillow overlies at least a portion of the first leg and a second position in which the first auxiliary pillow overlies the first end of the center section;

wherein the center section, first and second legs, and first auxiliary pillow each comprises compressible, resilient material.

27. The body pillow of claim 26 wherein the length of the first auxiliary pillow is less than half the length of the first leg and wherein the body pillow further comprises a flexible, elastic connecting section having first and second ends, the first end of the connecting section attached to the body and the second end of the connecting section is attached to the first end of the first auxiliary pillow.

28. The body pillow of claim 26 further comprising a second auxiliary pillow comprising compressible, resilient material, having a length, and being elastically attached to the body pillow.

29. The body pillow of claim 28 wherein the length of the first auxiliary pillow is less than half the length of the first leg, wherein the body pillow further comprises a flexible, elastic connecting section having first and second ends, the first end of the first connecting section attached to the body pillow and the second end of the first connecting section is attached to the first end of the first auxiliary pillow, wherein the length of the second auxiliary pillow is less than half the length of the second leg, wherein the body pillow further comprises a second flexible, elastic connecting section having first and second ends, the first end of the second connecting section attached to the body pillow and the second end of the second connecting section is attached to the first end of the second auxiliary pillow, wherein the first end of the second auxiliary pillow is elastically and pivotally attached to the body pillow at a location whereby the second auxiliary pillow is pivotable between a first position in which the second auxiliary pillow overlies at least a portion of the second leg and a second position in which the second auxiliary pillow overlies the second end of the center section.

30. The body pillow of claim 29 wherein the first auxiliary pillow is attached between the first end of the first leg and the first end of the center section and the second auxiliary pillow is attached between the first end of the second leg and the second end of the center section.

* * * * *